US005496382A

United States Patent [19]

Blain et al.

[11] Patent Number: 5,496,382

[45] Date of Patent: Mar. 5, 1996

[54] AMIDE/ESTER HETEROCYCLIC DERIVATIVES OF HYDROCARBYLSUCCINIC ANHYDRIDES AS RUST/CORROSION INHIBITING ADDITIVES FOR FUELS

[75] Inventors: David A. Blain, Gravenchon, France; Andrew G. Horodysky, Cherry Hill; Ronald J. Poole, Mullica Hill, both of N.J.; Shi-Ming Wu, Newtown, Pa.

[73] Assignee: Mobil Oil Corporation, Fairfax, Va.

[21] Appl. No.: 308,871

[22] Filed: Sep. 14, 1994

Related U.S. Application Data

[62] Division of Ser. No. 44,724, Apr. 12, 1993, Pat. No. 5,348, 674.

[51] Int. Cl.$^6$ ..... C10L 1/18; C10L 1/22

[52] U.S. Cl. ..... 44/331; 44/343

[58] Field of Search ..... 44/331, 343

[56] References Cited

U.S. PATENT DOCUMENTS

| | | | |
|---|---|---|---|
| 3,413,227 | 11/1968 | Howard et al. | 252/51.5 |
| 3,448,049 | 6/1969 | Preuss et al. | 252/51.5 |
| 3,597,353 | 8/1971 | Randell et al. | 252/50 |
| 3,788,993 | 1/1974 | Andress | 252/51.5 |
| 4,761,482 | 8/1988 | Karol | 548/142 |
| 4,810,261 | 3/1989 | Sung et al. | 44/331 |
| 4,895,579 | 1/1990 | Andress et al. | 44/331 |
| 4,976,746 | 12/1990 | Denis et al. | 44/331 |
| 5,160,349 | 11/1992 | Cardis et al. | 44/331 |
| 5,348,674 | 9/1994 | Blain et al. | 252/51.5 R |

*Primary Examiner*—Jacqueline V. Howard

*Attorney, Agent, or Firm*—Alexander J. McKillop; Malcolm D. Keen; Charles A. Malone

[57] ABSTRACT

Reaction products of hydrocarbylsuccinic anhydrides, hydroxyl-containing amines and triazoles have been found to be effective antirust, antioxidant, anti-corrosion, antiwear, dispersant/detergent and thermal color stabilizing additives.

10 Claims, No Drawings

AMIDE/ESTER HETEROCYCLIC DERIVATIVES OF HYDROCARBYLSUCCINIC ANHYDRIDES AS RUST/CORROSION INHIBITING ADDITIVES FOR FUELS

This application is a divisional of application Ser. No. 08/044,724 that was filed on Apr. 12, 1993, which issued as U.S. Pat. No. 5,348,674 on Sep. 20, 1994.

BACKGROUND OF THE INVENTION

1. Field of the Invention

This application is directed to reaction products of hydrocarbylsuccinic anhydrides, hydroxyl-containing amines and triazoles which exhibit excellent lubricating properties as well as effective multifunctional rust and corrosion inhibiting, antiwear and thermal color stabilizing, metal deactivating, antioxidant, dispersant and detergent characteristics when incorporated into lubricants and to lubricant compositions containing same.

2. Description of Related Art

Alkenylsuccinic anhydrides have been widely used in petroleum and synthetic lubricant products for their lubricity and solvency. Products made by reacting amines with alkyl or alkenylsuccinic anhydrides to form alkyl or alkenylsuccinimides are well known as detergents and dispersants for lubricants and fuels. Post-reaction of these succinimides to introduce other beneficial functional groups can be performed.

Triazoles have been employed in lubricant compositions as metal deactivators. For example, U.S. Pat. No. 3,597,353 (Randell et al.) discloses the use of 4,5,6,7-tetrahydrobenzotriazole as a metal deactivating additive for lubricants. The prior art also discloses that triazoles such as benzotriazole can be used as metal corrosion inhibiting and antirust agents. See U.S. Pat. No. 3,413,227.

We have found that the reaction products of hydrocarbylsuccinic anhydrides, hydroxyl-hydrocarbyl amines, and aryltriazoles have excellent antirust, anti-corrosion, antiwear, and thermal color stabilizing properties. These additives represent a novel class of ashless, non-sulfur/phosphorus-containing yet surface-active multifunctional additives. The composition of matter, the lubricant compositions containing such additives, and the use of such reaction products in lubricants to improve the performance properties are all believed to be unique and novel.

BRIEF SUMMARY OF THE INVENTION

This application is more particularly directed to the reaction products provided when a hydrocarbylsuccinic anhydride or its acid equivalent is reacted with a suitable hydroxyl-containing (or alkoxylated) amine and a suitable triazole. Reaction products of hydrocarbylsuccinic anhydrides, hydroxyl-containing amines and triazoles exhibit excellent lubricating properties in conjunction with metal deactivating, antioxidant, dispersant/detergent, rust/corrosion inhibiting, antiwear, and thermal color stabilizing characteristics. This application is also directed to lubricating compositions comprising such reaction products.

More specifically, this application is directed to lubricant compositions comprising a major amount of an oil of lubricating viscosity and a minor multifunctional amount of a reaction product prepared by reacting hydrocarbylsuccinic anhydrides or their acid equivalents with hydroxy-containing hydrocarbyl amines and triazoles.

An object of this invention is to provide additive products having superior and/or improved multifunctional characteristics for lubricant compositions. A further object is to provide improved lubricant compositions comprising such additive products.

It is also believed that the additive reaction products disclosed herein would be useful in fuel compositions.

DESCRIPTION OF PREFERRED EMBODIMENTS

Hydrocarbylsuccinic anhydrides can have the following structural formula:

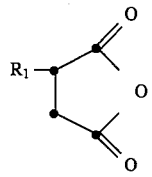

Where $R_1$ is hydrocarbyl, preferably an alkyl or alkenyl group having 1 to 300 carbon atoms, preferably $C_6$ to $C_{150}$ hydrocarbyl and more preferably $C_6$ to $C_{30}$ hydrocarbyl. Hydrocarbyl, as used herein, is selected from the group consisting of alkyl, alkenyl, aryl, aralkyl, alkaryl and may be cyclic or polycyclic and may contain O, N,S, or mixtures thereof.

Some suitable alkoxylated amines may have the following structural formulas:

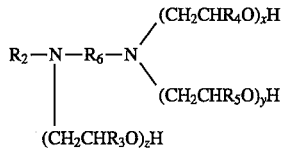

and

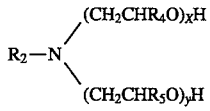

Where $R_2$ is hydrogen, or $C_1$ to $C_{100}$ hydrocarbyl, $R_3$, $R_4$ and $R_5$ are hydrogen, or $C_1$ to $C_{60}$ hydrocarbyl, $R_6$ is $C_2$ to about $C_{25}$ hydrocarbyl, and the R group can also optionally contain one or more heteroatoms such as sulfur, oxygen or nitrogen within the hydrocarbon chain, x=0–20, y=0–20, z=0–20 and x+y+z must equal at least 1.

Any suitable triazole may be used in the invention but especially advantageous are aryltriazoles such as benzotriazole, tolyltriazole, alkylated benzotriazole, and mixtures thereof.

Any hydrocarbylsuccinic anhydride which conforms to the structural formula shown above may be used in this invention. Especially preferred are alkyl-or alkenylsuccinic anhydrides or their acid equivalents. For example, dodecenylsuccinic anhydride is highly useful.

Any suitable hydroxyl-containing amine may be used. However, highly preferred are bis(2-hydroxyethyl) oleylamine, bis(2-hydroxyethyl) tallow amine, bis(2-hydroxyethyl) soya amine, and alkoxylated tallow diamine.

Often no solvent is necessary but if a solvent is, for some reason, desired, any suitable hydrocarbon solvent such as toluene or a xylene may be used.

Alternate stoichiometries, temperatures and reaction times can be used to form the desirable products. Mixtures of reactants can often be used to form products with exceptional activity.

The presence of free carboxylic group(s) in these additive reaction products is essential for rust and corrosion inhibiting properties. The triazole moiety provides the desirable thermal color stability characteristics.

Generally speaking, conditions for the herein-described reactions may vary widely depending upon specific reactants, the presence or absence of a solvent and the like. Any suitable set of reaction conditions known to the art may be used.

The reaction temperature may vary from ambient to about 250° C. or reflux, the pressure may be autogenous or vary from ambient to about 100 psi and the molar ratio of reactants (anhydride/hydroxy-containing amine/triazole) preferably varies from about 100/80/80 moles to about 100/10/1 moles. Preferably, the molar ratio of hydrocarbylsuccinic anhydride/hydroxy-containing amine/triazole is 4/2/1, respectively.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt.% based on the total weight of the composition can be used. Preferably, the concentration is from 0.1 to about 3 wt.%.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether and phenoxy phenylethers.

Fuels contemplated include liquid hydrocarbon and liquid oxygentated fuels such as alcohols and ethers. The additives can be blended in a concentration from about 0.1 to about 200 pounds of additive per 1000 barrels of fuel. The liquid fuel can be a liquid hydrocarbon fuel or an oxygenated fuel or mixtures thereof ranging from a ratio of hydrocarbon fuel to oxygenated fuel from about 99:1 to about 1:99. Liquid hydrocarbon fuels include gasoline, fuel oils, diesel oils and alcohol fuels include methyl and ethyl alcohols and ethers such as TAME, ETBE, DIPE and MTBE.

Specifically, the fuel compositions contemplated include gasoline base stocks such as a mixture of hydrocarbons boiling in the gasoline boiling range which is within a range of about 90° F. to about 450° F. This base fuel may consist of straight chains or branched chains or paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point within the range of about 75° F. to about 135° F. and an end boiling point within the range of about 250° F. to about 750° F. It should be noted in this respect that the term distillate fuels is not intended to be restricted to straight-run distillate fractions. These distillate fuel oils can be straight-run distillate fuel oils catalytically (including hydrocracked) or thermally cracked distillate fuel oils etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as Diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing little or no hydrocarbon. Typical of such fuels are methanol, ethanol and mixtures of methanol and ethanol. The fuels which may be treated with the additive include gasohols which may be formed by mixing 90 to 95 volumes of gasoline with 5–10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and are not meant to be limitations.

EXAMPLE 1

Approximately 106.4 g (0.40 mol) of dodecenylsuccinic anhydride and 70.5 g (0.20 mol) of bis(2-hydroxyethyl) oleylamine (Ethomeen O/12, commercially obtained from Akzo Chemicals, Inc.) were charged to a round-bottom flask under nitrogen. The mixture was stirred at 70° C. for 1 hour. Tolyltriazole (13.3 g, 0.10 mol) was then added and the mixture was heated to 120° C. for 3 hours to yield 188.7 g of viscous, clear, amber fluid.

EXAMPLE 2

Under the same reaction conditions as described in Example 1 was followed with one exception: Ethomeen T/12 [bis(2-hydroxyethyl)tallow amine, commercially obtained from Akzo Chemicals, Inc.] was used instead of Ethomeen O/12.

EXAMPLE 3

Under the same reaction conditions as described in Example 1 was followed with one exception: Ethomeen S/12 [bis(2-hydroxyethyl)soyamine, commercially obtained from Akzo Chemicals, Inc.] was used instead of Ethomeen T/12.

EXAMPLE 4

Under the same reaction conditions as described in Example 1 was followed with one exception: Ethoduomeen T/13 (alkoxylated tallow diamine, commercially obtained from Akzo Chemicals, Inc.) was used instead of Ethomeen O/12.

EXAMPLE 5

Under the similar reaction conditions as described in Example 1, however, the reaction was carried out in the mole ratio of 8/4/1 with respect to dodecenylsuccinic anhydride/Ethomeen T/12/tolyltriazole.

EVALUATION OF PRODUCTS

The products of the Examples were blended into partially formulated solvent paraffinic neutral mineral oils and evaluated for rust/corrosion inhibiting performance (Table 1), and for color stability upon heating in the presence of a copper catalyst (Table 2). These additives also exhibit antiwear properties as evident in the Four-Ball Wear Test results (Table 3).

Rust Test—ASTM—665

This method involves stirring a mixture of 300 ml. of the oil under test with 30 ml. of distilled or synthetic sea water, as required, at a temperature of 140° F. (60° C.) with a cylindrical steel specimen completely immersed therein. It is customary to run the test for 24 hours; however, the test period may, at the discretion of the contracting parties, be run for a shorter or longer period. Here, the test was run for 24 hours using synthetic sea water at 140° F.

Bethelem Steel Rust Test

Rust-preventing Characteristics of Gear and Heavy Circulating Oils in the Presence of Water (adopted 1984)

This method is used to indicated the ability of gear and heavy circulating oils to aid in preventing the rusting of ferrous parts should water become mixed with the oil.

A mixture of the test oil and water containing a completely immersed cylindrical steel specimen is stirred for 24 hours at 140° F. At the end of 24 hours, the specimen is removed, examined for rust and allowed to drain. After draining, the specimen is placed in to a beaker containing water at 140° F., with stirring, for 24 hours. At the end of 24 hours, the test specimen is removed from the beaker, examined for rust and returned to the beaker of water. The test is continued without stirring for 72 hours at 140° F. At the end of 72 hours, the test specimen is again examined for rust. If the oil received a rating of "severe failure" in the first part of the test, the test is discontinued.

| | |
|---|---|
| Min. Sample Size: | 350 ml |
| Range of Method: | — |
| Results Reported as: | Appearance of Rust on Steel Specimen |
| Reproducibility: | Not Established |
| Elapsed Time: | 120 Hours for Test plus 1 Hour Workup |

The Four Ball Wear Test was in accordance with ASTM Method D2266. For additional test details, see U.S. Pat. No. 4,761,482. K or the wear factor is calculated as shown below.

TABLE 1

| | Rust/Corrosion Tests | | | |
|---|---|---|---|---|
| Item | ASTM Copper Strip Corrosion (D130) (240° F. 3 hr) | ASTM Synthetic Sea Water (D665) (140° F. 24 hr) | ASTM Synthetic Sea Water (D665) (140° F. 48 hr) | Bethlehem Steel Rust Test Part C |
| Partially formulated base oil[a] | 2A | Fail | Fail | Severe 55% |
| 0.1% of Example 1 in above base oil | 2A | Pass | Pass | Pass |
| 0.1% of Example 2 in above base oil | 1B | Pass | Pass | Pass |
| 0.1% of Example 3 in above base oil | 1B | Pass | Pass | Pass |

TABLE 1-continued

| Item | Rust/Corrosion Tests | | | |
|---|---|---|---|---|
| | ASTM Copper Strip Corrosion (D130) (240° F. 3 hr) | ASTM Synthetic Sea Water (D665) (140° F. 24 hr) | ASTM Synthetic Sea Water (D665) (140° F. 48 hr) | Bethlehem Steel Rust Test Part C |
| 0.1% of Example 4 in above base oil | 1B | Pass | Pass | Pass |
| 0.1% of Example 5 in above base oil | 1B | Pass | Pass | Pass |

[a]210" SUS mixed solvent paraffinic neutral mineral oils plus antioxidant, extreme pressure/antiwear, viscosity index improver, demulsifier, and antifoam additives.

TABLE 2

| Item | Color Stability Test |
|---|---|
| | Relative ASTM Color/Copper Rating |
| Partially formulated base oil[a] | 3.5/5 |
| 0.1% of Example 1 in above base oil | 2/1 |
| 0.1% of Example 2 in above base oil | 2/1 |
| 0.1% of Example 3 in above base oil | 2/1 |
| 0.1% of Example 4 in above base oil | 2.5/3 |
| 0.1% of Example 5 in above base oil | 2/3 |

[a]210" SUS solvent paraffinic neutral mineral oils plus antioxidant, extreme pressure/antiwear, viscosity index improver, demulsifier, and and antifoam additives.

TABLE 3

| Item | Four-Ball Wear Test (40 Kg, 1800 rpm, 200° F., 30 min) | |
|---|---|---|
| | Wear Scar (mm) | K Factor ($K \times 10^{-8}$) |
| Base oil (80% solvent paraffinic bright and 20% solvent paraffinic neutral mineral oils) | 0.688 | 11.2 |
| 1% of Example 2 in above base oil | 0.503 | 2.8 |
| 1% of Example 3 in above base oil | 0.558 | 4.5 |
| 1% of Example 5 in above base oil | 0.528 | 3.5 |

*Wear Factor $$Kt = \frac{X}{PVI}$$

Kt = Wear factor (based on thickness change) (express as whole number times 10)
X = Thickness change, in (wear)
P = Contact Pressure, psi
V = Velocity, ft/min
T = Test Duration, h The use of additive concentrations of reaction products of the above-mentioned compositions in premium quality industrial, automotive and marine lubricants and fuels will provide multifunctional antirust/anticorrosion/antiwear properties as well as improve thermal color stability. These additives are readily prepared in a one-pot, two-step process without solvent.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. An improved fuel composition comprising a liquid hydrocarbon or liquid oxygenated fuel and a minor multifunctional antiwear, corrosion inhibiting, rust inhibiting, thermal color stabilizing, antioxidant, dispersant and detergent proportion of an additive product of reaction prepared by reacting (1) a hydrocarbylsuccinic anhydride or its acid equivalent with (2) a hydroxyl-containing amine and (3) an aryltriazole wherein the reaction is carried out in molar ratios of said anhydride to amine to triazole varying from about 100/80/80 to 100/10/1 at temperatures varying from ambient to about 250° C., under pressures varying from ambient to about 100 psi for a time sufficient to obtain the desired additive product of reaction.

2. The composition of claim 1 wherein the triazole is selected from the group consisting of benzotriazole, alkylated benzotriazoles and tolyltriazole.

3. The composition of claim 1 wherein the hydrocarbylsuccinic anhydride has the following structural formula:

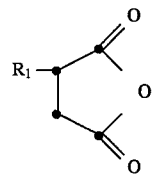

where $R_1$ is $C_1$ to about $C_{300}$ hydrocarbyl and where hydrocarbyl is selected from the group consisting of alkyl, alkenyl, aryl, alkaryl, aralkyl and may be cyclic or polycyclic and optionally contain S, O, N or mixtures thereof.

4. The composition of claim 1 wherein the hydroxyl-containing amines are selected from amines having the following structural formulas.

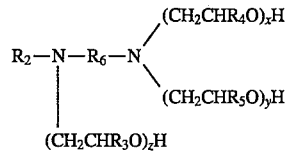

and

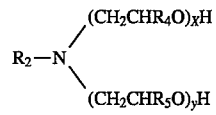

where $R_2$ is hydrogen or $C_1$ to about $C_{100}$ hydrocarbyl, and where $R_3$, $R_4$, and $R_5$ are hydrogen or $C_1$ to about $C_{60}$ hydrocarbyl and where $R_6$ is $C_2$ to about $C_{25}$ hydrocarbyl and wherein hydrocarbyl is selected from the group consisting of alkyl, alkenyl, aryl, alkaryl or aralkyl and optionally contains O, S, or N or mixtures thereof and where X=0–20, Y=0–20, and X+Y+Z must equal at least 1.

5. The composition of claim 1 wherein the reactants are dodecenylsuccinic anhydride, bis(2-hydroxyethyl)-oleylamine and tolyltriazole.

6. The composition of claim 1 wherein the reactants are dodecenylsuccinic anhydride, bis(2-hydroxyethyl)tallow amine and tolyltriazole.

7. The composition of claim 1 wherein the reactants are dodecenylsuccinic anhydride, bis(2-hydroxyethyl)soya amine and tolyltriazole.

8. The composition of claim 1 wherein the reactants are dodecenylsuccinic anhydride, alkoxylated tallow diamine, and tolyltriazole.

9. The composition of claim 1 wherein 1,000 barrels of the fuel contains from about 0.1 to about 200 pounds of the composition of the additive product of reaction.

10. The composition of claim 1 wherein the fuel comprises gasoline, fuel oils, diesel fuel oil, and alcohol fuels.

* * * * *